US009217216B2

(12) United States Patent
Choi et al.

(10) Patent No.: US 9,217,216 B2
(45) Date of Patent: Dec. 22, 2015

(54) WASHING MACHINE

(75) Inventors: Yun Ho Choi, Suwon-si (KR); Jae Han Lim, Suwon-si (KR); Seung Hwan Chung, Suwon-si (KR); Young Mi Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1051 days.

(21) Appl. No.: 13/317,413

(22) Filed: Oct. 18, 2011

(65) Prior Publication Data

US 2012/0096652 A1 Apr. 26, 2012

(30) Foreign Application Priority Data

Oct. 20, 2010 (KR) ..... 10-2010-0102220

(51) Int. Cl.

| | |
|---|---|
| ***D06F 35/00*** | (2006.01) |
| ***D06F 39/08*** | (2006.01) |
| ***D06F 23/04*** | (2006.01) |
| ***D06F 21/08*** | (2006.01) |

(52) U.S. Cl.

CPC ..... *D06F 35/002* (2013.01); *D06F 21/08* (2013.01); *D06F 23/04* (2013.01); *D06F 39/083* (2013.01)

(58) Field of Classification Search

CPC ..... D06F 35/002; D06F 39/083; D06F 23/04
USPC ..... 68/23.5, 183, 207
See application file for complete search history.

(56) References Cited

U.S. PATENT DOCUMENTS

| | | | | | |
|---|---|---|---|---|---|
| 3,604,225 | A | * | 9/1971 | Douglas | 68/23.5 |
| 4,809,524 | A | * | 3/1989 | Sickert et al. | 68/148 |
| 5,285,664 | A | * | 2/1994 | Chang et al. | 68/18 F |
| 5,582,039 | A | * | 12/1996 | Mueller et al. | 68/17 R |
| 5,657,650 | A | * | 8/1997 | Lee et al. | 68/23.5 |
| 5,687,440 | A | * | 11/1997 | Min et al. | 8/158 |
| 5,749,248 | A | | 5/1998 | Kim | |
| 5,823,018 | A | * | 10/1998 | Lee | 68/23.5 |

(Continued)

FOREIGN PATENT DOCUMENTS

| | | |
|---|---|---|
| CN | 101285254 | 10/2008 |
| CN | 101845737 | 9/2010 |
| KR | 10-2000-0045030 | 7/2000 |
| KR | 10-2004-0089523 | 10/2004 |

OTHER PUBLICATIONS

Machine translation of KR 10-2000-0045030 to Kim, no date.*

(Continued)

*Primary Examiner* — Joseph L Perrin
(74) *Attorney, Agent, or Firm* — Staas & Halsey LLP

(57) ABSTRACT

A washing machine that circulates wash water and, at the same time, generates bubbles in the wash water. The washing machine includes a machine body, a tub disposed in the machine body. a tub cover provided above the tub, a pump mounted below the tub, and a circulation unit, having one end coupled to the pump and the other end coupled to the tub cover, to circulate wash water from the pump to the tub. The circulation unit includes a first channel, a second channel communicating with the first channel, the second channel having a smaller sectional area than the first channel, and an air inlet port provided in the second channel to allow air to be introduced into the circulation unit therethrough.

22 Claims, 11 Drawing Sheets

(56) References Cited

U.S. PATENT DOCUMENTS

| | | | | |
|---|---|---|---|---|
| 5,937,677 | A * | 8/1999 | Lee | 68/23.5 |
| 2007/0101774 | A1* | 5/2007 | Lee | 68/208 |
| 2008/0250823 | A1* | 10/2008 | Oak et al. | 68/5 C |
| 2010/0000266 | A1* | 1/2010 | Chung et al. | 68/205 R |
| 2010/0126236 | A1* | 5/2010 | Seo et al. | 68/23 R |
| 2011/0048078 | A1* | 3/2011 | Tobi et al. | 68/12.13 |

OTHER PUBLICATIONS

Australian Office Action issued Nov. 28, 2012 in corresponding Australian Patent Application No. 2011235965.

Chinese Office Action issued Dec. 1, 2014 in corresponding Chinese Application No. 201110320057.6.

* cited by examiner

WASHING MACHINE

CROSS-REFERENCE TO RELATED APPLICATIONS

This application claims the benefit of Korean Patent Application No. 10-2010-0102220, filed on Oct. 20, 2010 in the Korean Intellectual Property Office, the disclosure of which is incorporated herein by reference.

BACKGROUND

1. Field

Embodiments of the present disclosure relate to a structure to circulate wash water into a tub and a rotary tub of a washing machine.

2. Description of the Related Art

A washing machine washes laundry using electric power. Generally, the washing machine includes a tub to contain wash water, a rotary tub rotatably mounted in the tub, a pulsator rotatably mounted at the bottom of the rotary tub, and a motor to drive the rotary tub and the pulsator.

When the rotary tub and the pulsator are rotated by the motor in a state in which laundry and washing water are contained in the rotary tub, the pulsator stirs the laundry in the rotary tub together with the wash water to remove contaminants from the laundry.

The washing machine may further include a wash water circulation unit to circulate wash water, thereby reducing the amount of wash water and detergent used to wash laundry and total washing time. The wash water circulation unit, including a circulation pump and a circulation hose, sprays the wash water used to wash the laundry into the rotary tub.

SUMMARY

It is an aspect of the present disclosure to provide a washing machine that circulates wash water and, at the same time, generates bubbles in the wash water.

It is another aspect of the present disclosure to provide a washing machine that generates bubbles in wash water through a simple structure.

Additional aspects of the disclosure will be set forth in part in the description which follows and, in part, will be apparent from the description, or may be learned by practice of the disclosure.

In accordance with one aspect of the present disclosure, a washing machine includes a machine body, a tub disposed in the machine body, a tub cover provided above the tub, a pump mounted below the tub, and a circulation unit, having one end coupled to the pump and the other end coupled to the tub cover, to circulate wash water from the pump to the tub, wherein the circulation unit includes a first channel, a second channel communicating with the first channel, the second channel having a smaller sectional area than the first channel, and an air inlet port provided in the second channel to allow air to be introduced into the circulation unit therethrough.

The circulation unit may include a connector provided at the tub cover and a circulation hose connected between the pump and the connector.

The first channel and the second channel may be provided in the circulation hose.

The air inlet port may communicate with the tub or the tub cover.

The circulation unit may include a connection pipe provided at the tub cover and a connection hose, having one end coupled to the connection pipe and the other end coupled to the air inlet port, to guide air from the tub cover to the air inlet port.

The tub cover may further include a movement preventing rib protruding from one side of the tub cover to prevent movement of the connection hose.

The first channel and the second channel may be provided in the connector.

The connector may be provided at one side of the tub cover and inclined upward to the bottom of the tub cover.

The air inlet port may be provided at then outer circumference of the connector so as to communicate with the second channel.

The air inlet port may be disposed inside the tub.

A check valve may be provided in the air inlet port.

In accordance with another aspect of the present disclosure, a washing machine includes a machine body, a tub disposed in the machine body, a tub cover provided above the tub, a pump mounted below the tub, and a circulation unit to circulate wash water to the tub, wherein the circulation unit includes a connector formed at one side of the tub cover and a circulation hose connected between the connector and the pump, the circulation hose including a wash water channel to guide the wash water into the tub and an air channel connected to the wash water channel to supply air to the wash water.

The connector may include an inlet port into which the wash water having passed through the circulation hose is introduced, and the wash water channel may include a first channel communicating with the inlet port and a second channel communicating with the first channel, the second channel having a smaller diameter than the first channel.

The air channel may communicate with the second channel.

The circulation unit may further include a connection pipe provided at the tub cover and a connection hose, having one end coupled to the connection pipe and the other end coupled to the air channel, to guide air from the tub cover to the air channel.

The tub cover may further include a movement preventing rib protruding from one side of the tub cover to prevent movement of the connection hose.

In accordance with a further aspect of the present disclosure, a washing machine includes a machine body, a tub disposed in the machine body, a tub cover provided above the tub, a connector provided at the tub cover, and a circulation hose connected between the tub cover and the connector, wherein the connector includes a first channel and a second channel communicating with the first channel, the second channel having a smaller sectional area than the first channel.

The connector may be provided at the side of the tub cover and inclined upward to the bottom of the tub cover.

The connector may be provided at the outer circumference thereof with an air channel communicating with the second channel.

The connector may be provided at one end thereof with a coupling part coupled to the circulation hose, the coupling part having an inlet port communicating with the first channel.

The air channel may be disposed inside the tub and the inlet port may be disposed outside the tub.

The connector may be provided at the other end thereof with an outlet port communicating with the second channel.

A one-way valve may be further provided in the air channel to prevent the wash water passing through the second channel from being introduced into the tub through the air channel.

The connector may be integrally formed at the tub cover.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
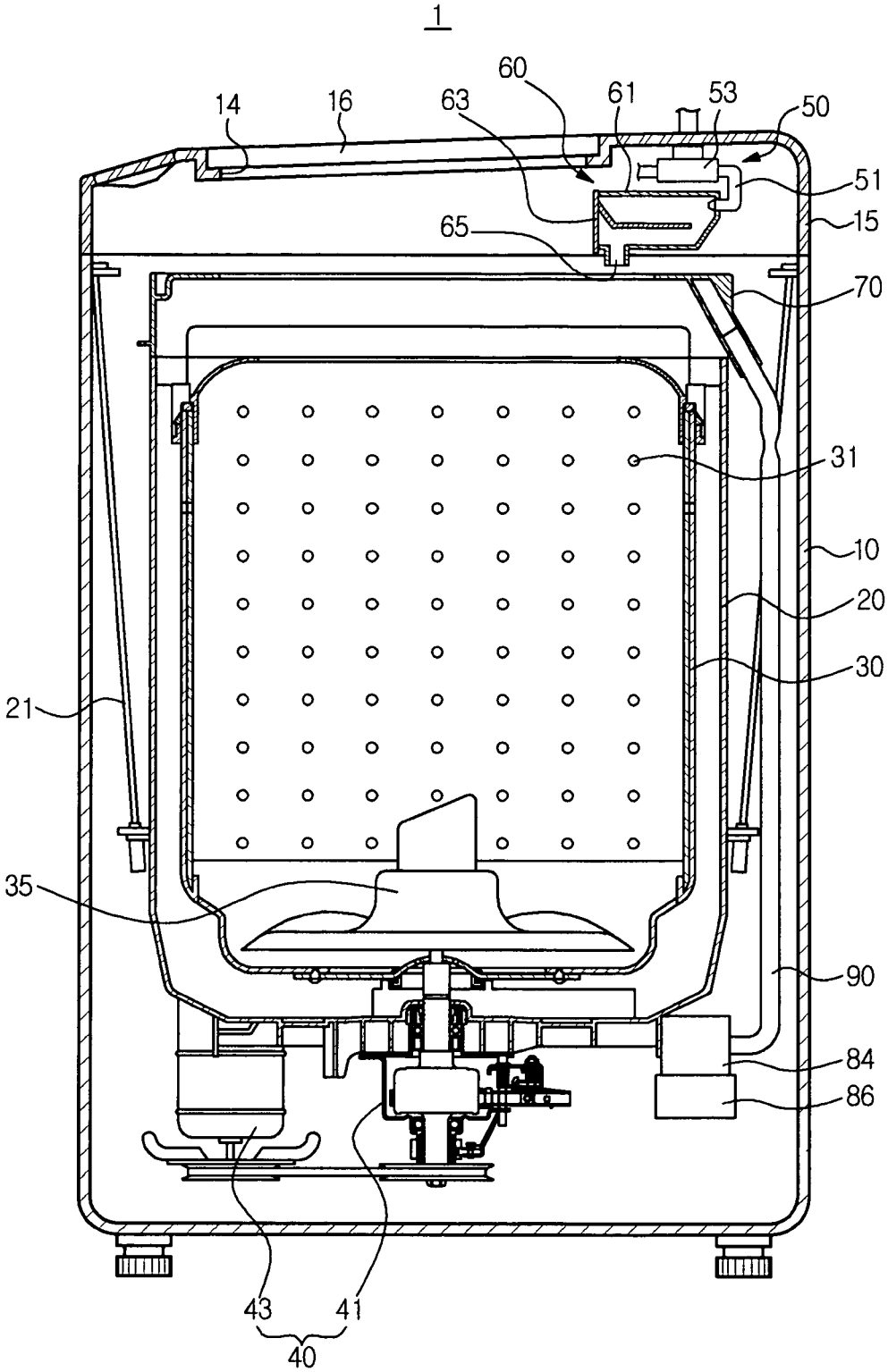
FIG. 1 is a sectional view showing a washing machine according to an embodiment of the present disclosure.

Reference will now be made in detail to the embodiments of the present disclosure, examples of which are illustrated in the accompanying drawings, wherein like reference numerals refer to like elements throughout.

FIG. 1 is a sectional view showing a washing machine 1 according to an embodiment of the present disclosure.

As shown in FIG. 1, the washing machine 1 includes a machine body 10 forming the external appearance thereof, a tub 20 disposed in the machine body 10, a rotary tub 30 rotatably disposed in the tub 20, and a drive unit 40 disposed below the tub 20 to rotate the rotary tub 30.

Above the machine body 10 is provided a cover 15 having a laundry introduction port 14, through which laundry is introduced into the rotary tub 30. A door 16 to open and closed the laundry introduction port 14 is provided at the cover 15.

To the outside of the tub 20 is connected a suspension 21 to support the tub 20 in a state in which the tub 20 is suspended from the machine body 10. To the top of the tub 20 is coupled an annular tub cover 70 to cover the tub 20.

The rotary tub 30 is rotatably disposed in the tub 20. The rotary tub 30 has a plurality of through holes 31.

A pulsator 35 is rotatably mounted at the bottom of the rotary tub 30. The pulsator 35 serves to stir laundry placed in the rotary tub 30 together with wash water.

The drive unit 40 includes a clutch 41 to rotate the rotary tub 30 and the pulsator 35 and a drive motor 43 to drive the clutch 41. The drive motor 43 is connected to the clutch 41 via a pulley and a belt to transmit drive force to the rotary tub 30 and the pulsator 35.

Above the tub 20 is mounted a water supply unit 50 to supply wash water to the tub 20. The water supply unit 50 includes a water supply valve 53 to control the supply of water and a water supply pipe 51 connected between the water supply valve 53 and a detergent supply unit 60.

One end of the water supply pipe 51 is connected to an external water supply source (not shown), and the other end of the water supply pipe 51 is connected to the detergent supply unit 60.

The detergent supply unit 60 includes a case 61 disposed in the cover 15 and a detergent container 63 detachably mounted in the case 61 to store a detergent. The case 61 is provided at the bottom thereof with a discharge port 65 through which wash water containing the detergent dissolved therein is discharged.

Water introduced through the water supply pipe 51 flows through the detergent supply unit 60 with the result that the water is supplied into the tub together with the detergent.

Figure 2:
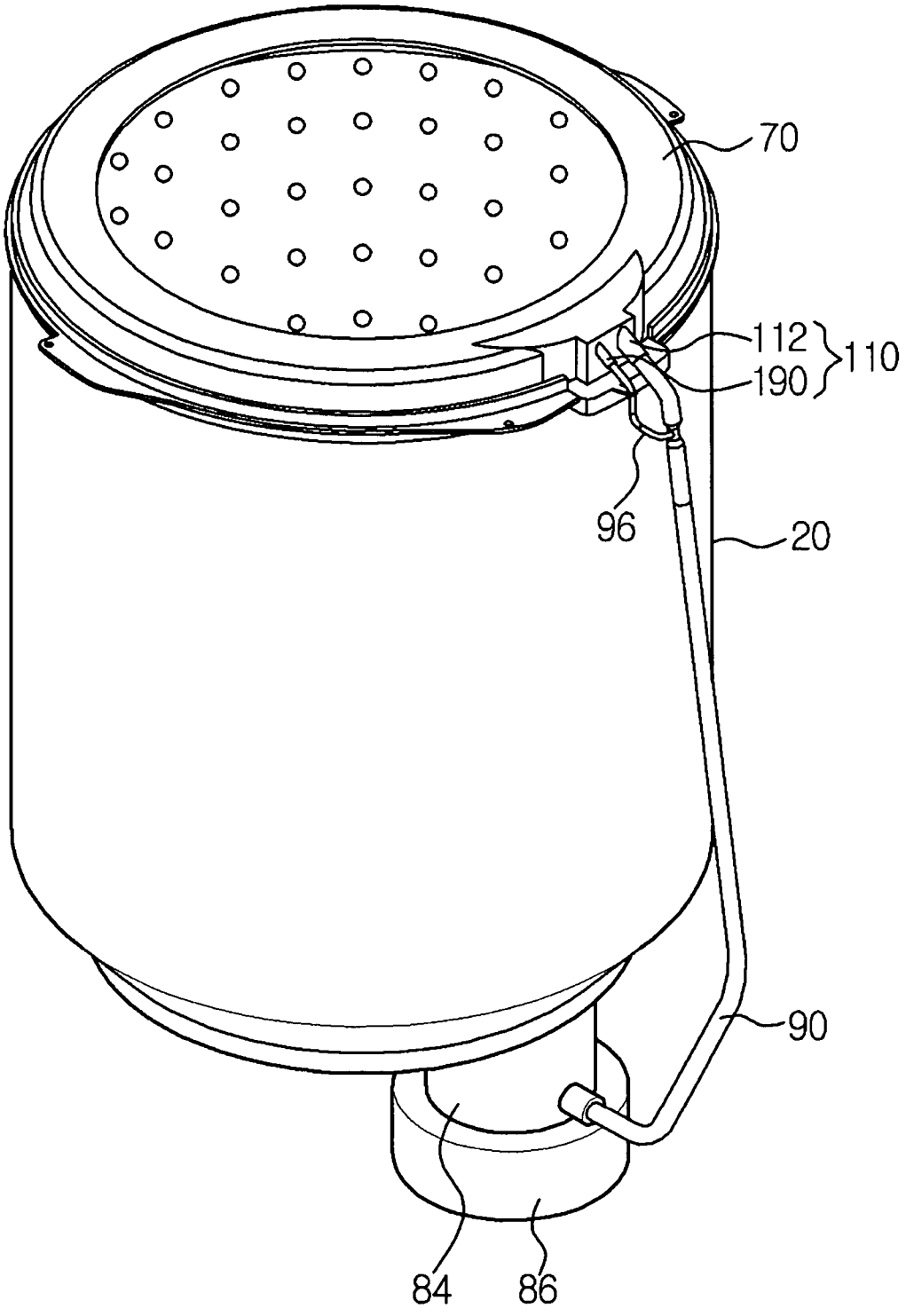
FIG. 2 is a perspective view showing a tub and a circulation unit of FIG. 1.
Figure 3:
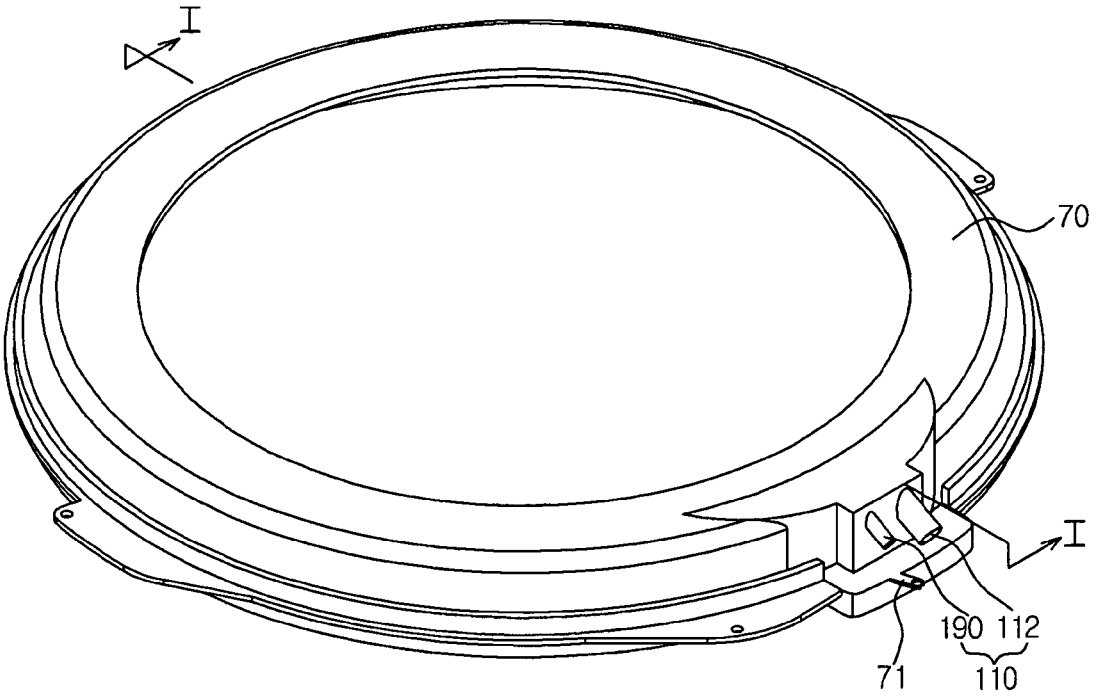
FIG. 3 is a perspective view showing a tub cover of FIG. 2.

FIG. 2 is a perspective view showing the tub and a circulation unit of FIG. 1, and FIG. 3 is a perspective view showing the tub cover of FIG. 2.

As shown in FIGS. 2 and 3, the circulation unit is connected to a circulation pump 84. The circulation unit includes a connector 110, a circulation hose 90 and a connection hole 96.

The circulation pump 84 is mounted below the tub 20 to transfer wash water introduced from the rotary tub 30 and the tub 20 to the top of the tub 20. The motor 86 provides drive force to the circulation pump 84 so that the circulation pump 84 is driven.

The connector 110 is provided at one side of the tub cover 70. The connector 110 includes a first connection pipe 112 and a second connection pipe 190.

The wash water transferred by the circulation pump 84 is sprayed into the tub 20 and the rotary tub 30 through the first connection pipe 112.

The interior of the first connection pipe 112 is formed in a hollow cylindrical shape. A coupling part 150, coupled to the circulation hose 90, is provided at one end of the first connection pipe 112. The coupling part 150 is provided at the interior thereof with an inlet port 152 through which wash water is introduced. The circulation hose 90 is fitted on or in the coupling part 150. As the wash water, having passed through the circulation hose 90, is introduced into the first connection pipe 112 through the inlet port 152, water leakage does not occur.

An outlet port 154 (see FIG. 4) is provided at the other end of the first connection pipe 112, i.e. the end of the first connection pipe 112 opposite to the inlet port 152.

The outlet port 154 is formed so as to be directed toward the bottom 74 (see FIG. 4) of the tub cover 70. A predetermined gap H (see FIG. 4) is defined between the outlet port 154 and the bottom 74 of the tub cover 70 so that the wash water, having passed through the first connection pipe 112, falls in a state in which the wash water is uniformly dispersed in the lateral direction.

The gap H may be 4 to 6 mm.

The second connection pipe 190 is provided at one side of the tub cover 70. Air from the tub 20 is introduced into the circulation hose 90 through the second connection pipe 190 and the connection hose 96.

The connector 110 may be integrally formed at the tub cover 70. The tub cover 70 is manufactured by injection molding. The connector 110 may be integrally formed in an injection molding device to injection mold the tub cover 70 so that the tub connector 70 and the connector 110 are manufactured as a single body.

Integral forming of the tub cover 70 and the connector 110 reduces connector manufacturing costs. Also, a process of coupling the connector 110 to the tub cover is omitted, thereby reducing production costs.

The tub cover 70 and the connector 110 may be formed of a plastic material, such as polycarbonate (PC) or acrylonitrile butadiene styrene (ABS), exhibiting strength to prevent deformation of the tub cover 70 and the connector 110 during the rotation of the tub cover 70 and the connector 110 in a coupled state.

Figure 4:
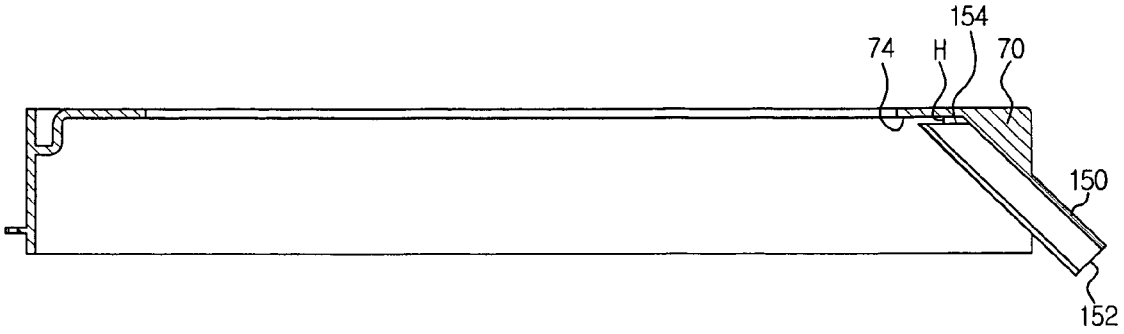
FIG. 4 is a sectional view taken along line I-I of FIG. 3.
Figure 5:
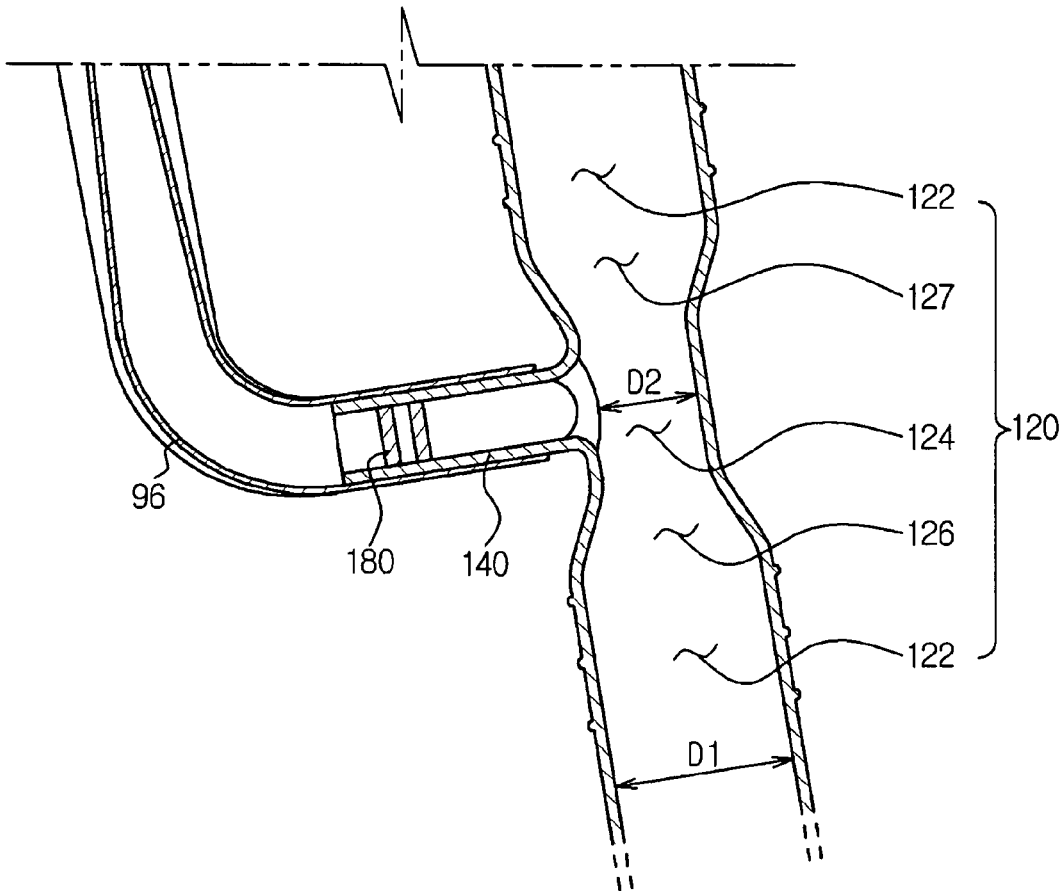
FIG. 5 is a sectional view showing a circulation hose and a connection hose of FIG. 2.
Figure 6:
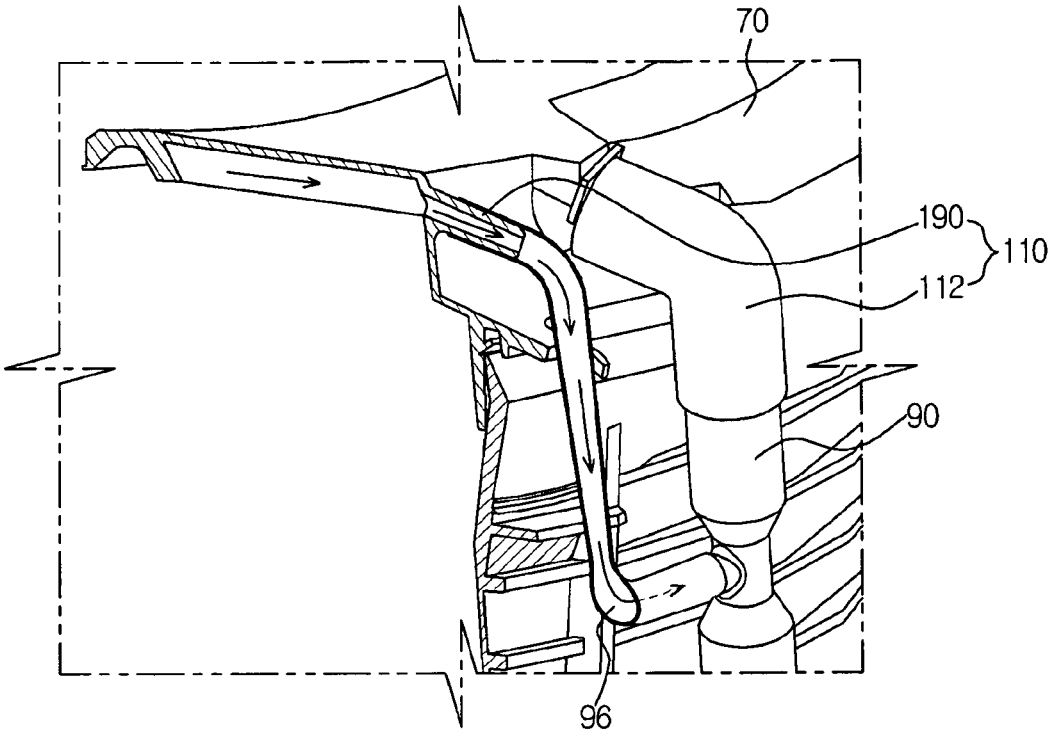
FIG. 6 is a view showing the flow of air introduced into the circulation hose through the connection hose.

FIG. 4 is a sectional view taken along line I-I of FIG. 3, FIG. 5 is a sectional view showing the circulation hose and the connection hose of FIG. 2, and FIG. 6 is a view showing the flow of air introduced into the circulation hose through the connection hose.

As shown in FIGS. 3 to 6, the circulation hose 90 is connected between the circulation pump 84 and the first connection pipe 112. One end of the circulation hose 90 is coupled to the circulation pump 84, and the other end of the circulation hose 90 is coupled to the first connection pipe 112.

In the circulation hose 90 is provided a wash water channel 120 through which wash water flows.

The wash water channel 120, having an approximately circular section, extends through the circulation hose 90. The wash water channel 120 includes first channels 122 and a second channel 124.

The first channels 122 are connected to the circulation pump 84 and the first connection pipe 112. The second channel 124 is provided between the first channels 122. The second channel 124 has a diameter D2 less than a diameter D1 of the first channels 122. The second channel 124 extends a predetermined length in the circulation hose 90.

A diameter reduction part 126 and a diameter extension part 127 are provided between the respective first channels 122 and the second channel 124 to reduce resistance applied to wash water when the wash water moves from one of the first channels 122 to the second channel 124 or from the second channel 124 to the other first channel 122.

The circulation hose 90 includes an air inlet port 140 through which air is introduced into the wash water channel 120.

The air inlet port 140 extends through the interior of the circulation hose 90 from the outer circumference of the circulation hose 90 so as to communicate with the second channel 124.

The diameter of the air inlet port 140 may be less than the diameter D2 of the second channel 124 so as to achieve smooth flow of air.

The connection hose 96 is provided between the second connection pipe 190 and the air inlet port 140 so that the second connection pipe 190 and the air inlet port 140 communicate with each other. One end of the connection hose 96 is coupled to the second connection pipe 190 and the other end of the connection hose 96 is coupled to the air inlet port 140 so that air from the tub 20 is introduced into the circulation hose 90.

The second connection pipe 190 may be level with or higher than the air inlet port 140.

At the initial operating stage or the last operating stage of the circulation pump 84, pressure applied to laundry is small or irregular as compared with the normal operating stage of the circulation pump 84. In this case, the Venturi effect does not normally occur in the circulation hose 90 with the result that air may not be introduced into the second channel 124 and wash water flowing through the second channel 124 may fall through the air inlet port 140 due to gravity. In a case in which the second connection pipe 190 is level with or higher than the air inlet port 140, air in the tub 20 naturally flows from top to bottom. Consequently, it may not be necessary to greatly increase the speed of wash water to introduce air, thereby reducing power consumption used to drive the circulation pump 84, which pumps wash water.

The connector 110, the wash water channel 120, the air inlet port 140 and the connection hose 96 constitute a structure to generate bubbles in circulating wash water, i.e. a bubble generator.

The connection hose 96 may be coupled to a movement preventing rib 71 provided at the tub cover 70. The movement preventing rib 71 protrude from one side of the tub cover 70 in a shape surrounding the connection hose 96.

The movement of the connection hose 96 due to vibration, which may be generated during operation of the washing machine, is prevented through coupling between the connection hose 96 and the movement preventing rib 71. Also, damage to the connection hose 96 or collision noise caused by collision between the connection hose 96 and the tub 20 due to movement of the connection hose 96 is prevented.

Although not shown, a rib to prevent the movement of the circulation hose 90 may be provided at the tub 20 or the tub cover 70.

The connection hose 96 is not indispensable. That is, one end of the air inlet port 140 may be formed so as to be fitted in one end of the second connection pipe 190 so that the air inlet port 140 and the second connection pipe 190 are directly coupled to each other.

The circulation hose 90 and the connection hose 96 are made of a synthetic resin, such as synthetic rubber. Even when the circulation hose 90 and the connection hose 96 collide with the outside of the tub 20 due to external impact or internal vibration, therefore, the circulation hose 90 and the connection hose 96 may stably guide wash water and air without damage thereto.

Hereinafter, the principle by which air is supplied to wash water flowing in the circulation hose 90 through the air inlet port 140 will be described.

When the wash water, flowing through the first channel 122, is introduced into the second channel 124, the diameter of which is less than that of the first channel 122, the flow speed of the wash water introduced into the second channel 124 becomes faster than that of the wash water flowing through the first channel 122 with the result that the pressure of the wash water is reduced in proportion to the increased flow speed of the wash water.

At this time, the pressure difference between the second channel 124 and the outside of the circulation hose 90 occurs in proportion to the reduced pressure in the second channel 124. Due to the pressure difference, external air from the circulation hose 90 is introduced into the second channel 124 through the air inlet port 140 with the result that the air is mixed with the wash water.

Such a phenomenon is called the Venturi effect in which, when a fluid flows through channels having different diameters or sectional areas, the flow speed of the fluid increases in proportion to the square of the diameter and the pressure of the fluid decreases in proportion to the square of the increased flow speed of the fluid.

In the structure in which the circulation hose 90 is constituted by channels having different diameters, and the air inlet port 140 is further provided, the wash water is circulated and, at the same time, air is supplied to the wash water to generate bubbles.

An electronic control valve 180 may be further provided in the air inlet port 140.

The electronic control valve 180 is opened or closed by an additional controller (not shown). In a case in which the electronic control valve 180 is used, wash water may be circulated in a state in which air is supplied to the wash water (hereinafter, referred to as a 'bubble mode') or wash water may be circulated in a state in which air is not supplied to the wash water (hereinafter, referred to as a 'circulation mode').

That is, when the electronic control valve 180 is opened, air is introduced into the circulation hose 90 through the air inlet port 140 with the result that the air is supplied to the wash water, and bubbles are generated as the wash water falls into the rotary tub 30 (bubble mode). When the electronic control valve 180 is closed, air is not introduced into the circulation hose 90 with the result that the wash water is circulated in a state in which air is not supplied to the wash water (circulation mode).

Figure 7:
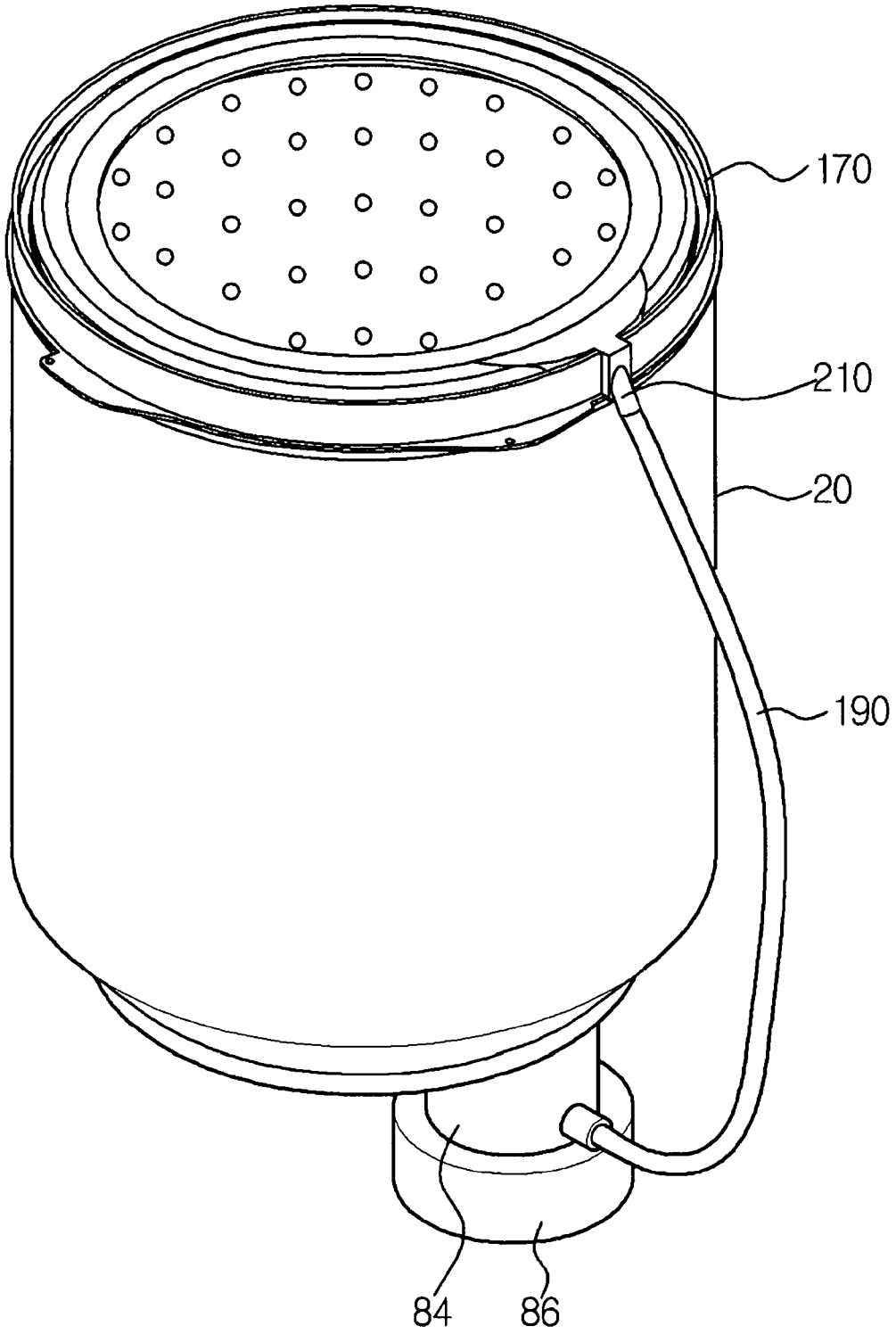
FIG. 7 is a perspective view showing a tub and a circulation unit according to another embodiment of the present disclosure.

FIG. 7 is a perspective view showing a tub and a circulation unit according to another embodiment of the present disclosure.

As shown in FIG. 7, the circulation unit is connected to the circulation pump 84. The circulation unit includes a connector 210 and a circulation hose 190.

The circulation pump 84 is mounted below the tub 20 to transfer wash water introduced from the rotary tub 30 and the tub 20 to the top of the tub 20. The motor 86 provides drive force to the circulation pump 84 so that the circulation pump 84 is driven.

The connector 210 is provided at a tub cover 170 to spray the wash water transferred by the circulation pump 84 into the tub 20 and the rotary tub 30. The detailed structure of the connector 210 will be described below.

The circulation hose 190 is connected between the circulation pump 84 and the connector 210. One end of the circulation hose 190 is coupled to the circulation pump 84, and the other end of the circulation hose 190 is coupled to the connector 210.

The wash water, pumped by the circulation pump 84, flows to the top of the machine body 10 through the circulation hose 190 and is then introduced into the connector 210.

The circulation hose 190 is made of synthetic resin, such as synthetic rubber. Even when the circulation hose 190 collides with the outside of the tub 20 due to external impact or internal vibration, therefore, the circulation hose 190 may stably guide wash water without damage thereto.

Figure 8:
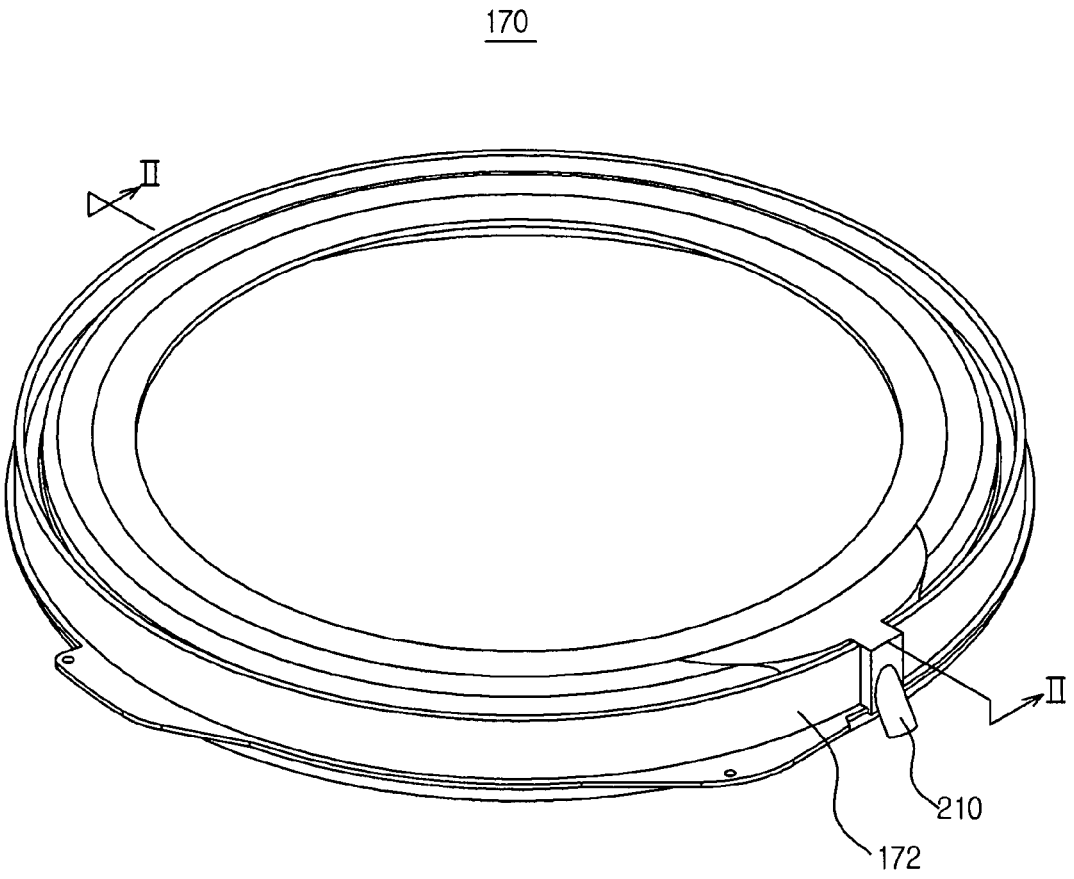
FIG. 8 is a perspective view showing a tub cover of FIG. 7.
Figure 9:
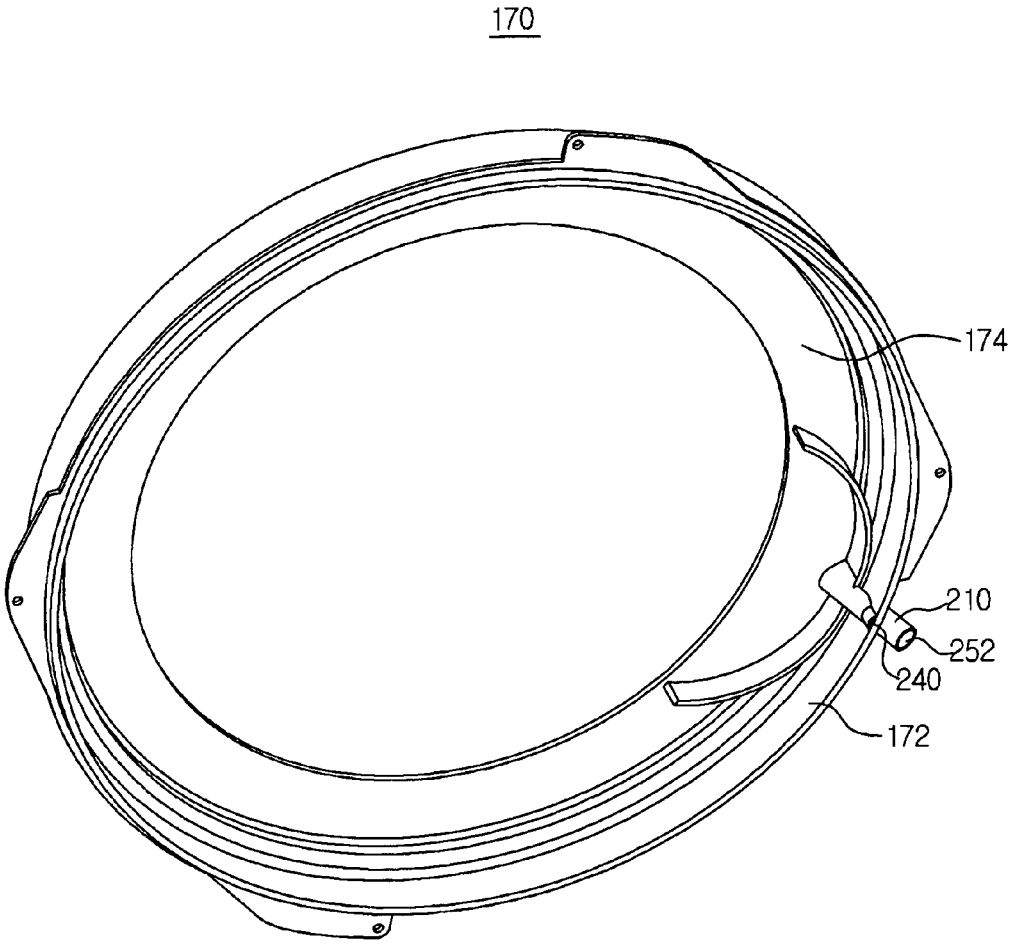
FIG. 9 is a bottom perspective view showing the tub cover of FIG. 8.
Figure 10:
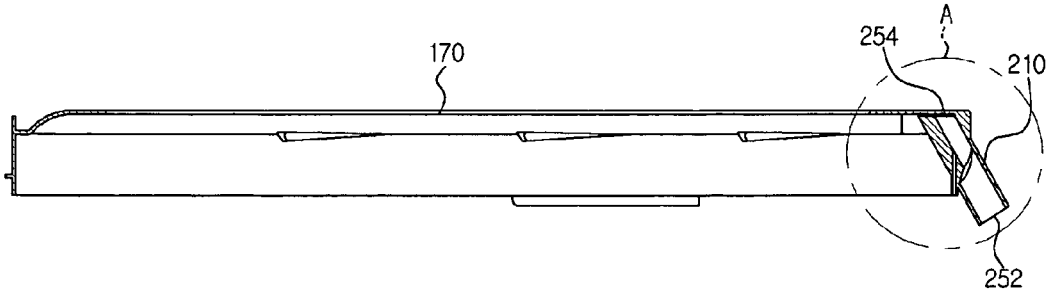
FIG. 10 is a sectional view taken along line II-II of FIG. 8.
Figure 11:
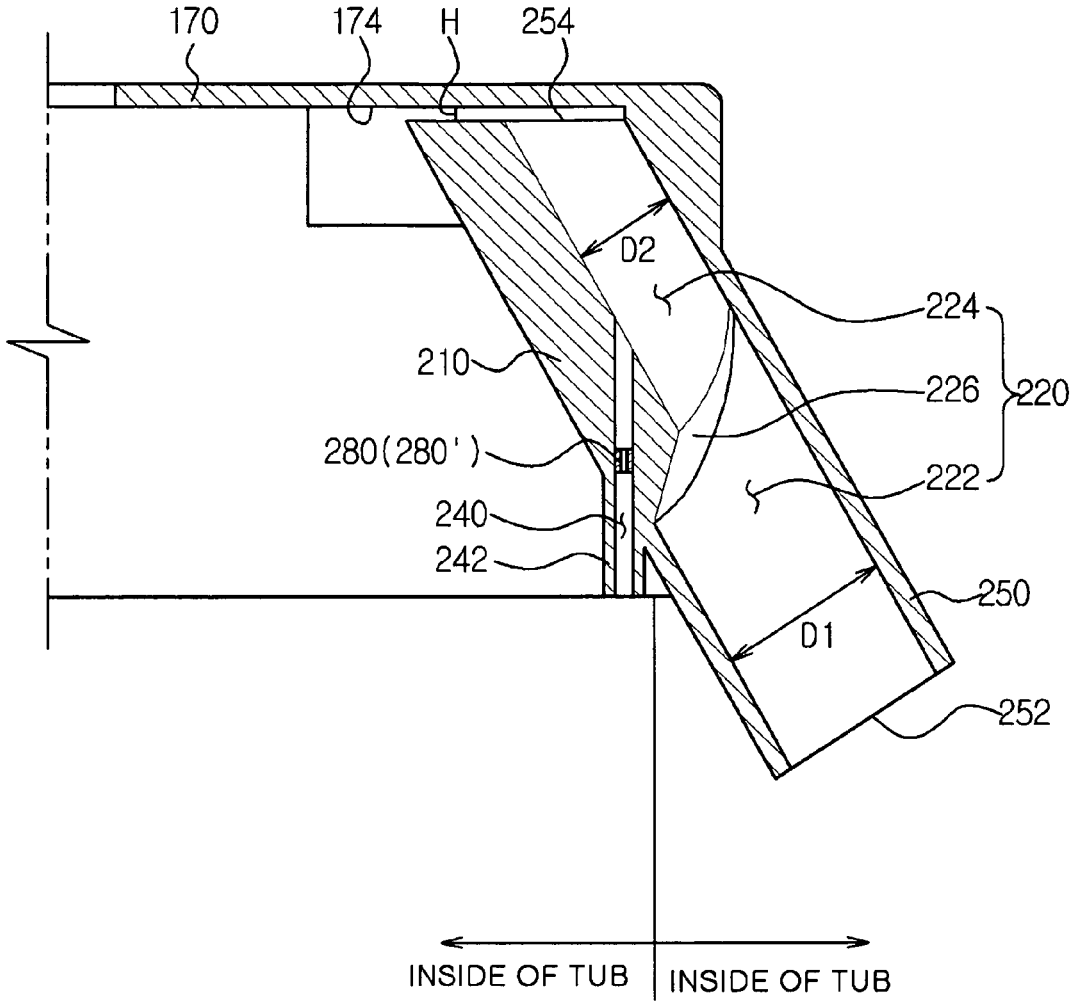
FIG. 11 is an enlarged sectional view showing an 'A' part of FIG. 10.

FIG. 8 is a perspective view showing the tub cover of FIG. 7, FIG. 9 is a bottom perspective view showing the tub cover of FIG. 8, FIG. 10 is a sectional view taken along line II-II of FIG. 8, and FIG. 11 is an enlarged sectional view showing an 'A' part of FIG. 10.

As shown in FIGS. 8 to 11, the connector 210 is provided at one side 172 of the tub cover 170.

The interior of the connector 210 is formed in a hollow cylindrical shape. The connector 210 is inclined upward to the bottom of the tub cover 170.

The connector 210 is inclined upward so that the wash water, transferred through the circulation hose 190 located at the outside of the tub 20, is guided into the tub 20.

A coupling part 250, coupled to the circulation hose 190, is provided at one end of the connector 210. The coupling part 250 is provided at the interior thereof with an inlet port 252 through which wash water is introduced.

The circulation hose 190 is fitted on or in the coupling part 250. While the wash water, having passed through the circulation hose 190, is introduced into the connector 210 through the inlet port 252, therefore, water leakage does not occur.

In the connector 210 is provided a wash water channel 220 through which wash water flows.

The wash water channel 220, having an approximately circular section, extends through the connector 210. The wash water channel 220 includes a first channel 222 and a second channel 224.

The first channel 222, communicating with the inlet port 252, extends a predetermined length in the connector 210. The second channel 224, communicating with the first channel 222, extends a predetermined length in the connector 210 so that the second channel 224 has a diameter D2 less than a diameter D1 of the first channel 222.

A diameter reduction part 226 is provided between the first channel 222 and the second channel 224 to reduce resistance applied to wash water when the wash water moves from the first channel 222 to the second channel 224.

An outlet port 254 is provided at the other end of the connector 210, i.e. the end of the connector 210 opposite to the inlet port 252.

The outlet port 254 communicates with the second channel 224 so that the wash water, having passed through the wash water channel 220, falls into the tub 20 and the rotary tub 30.

The outlet port 254 is formed so as to be directed toward the bottom 174 of the tub cover 170. A predetermined gap H is defined between the outlet port 254 and the bottom 174 of the tub cover 170 so that the wash water, having passed through the connector 210, falls in a state in which the wash water is uniformly dispersed in the lateral direction.

The gap H may be 4 to 6 mm.

At the outer circumference of the connector 210 is provided an air inlet port 240 through which air is introduced into the wash water channel 220.

The air inlet port 240 extends through the interior of the connector 210 from the outer circumference of the connector 210 so as to communicate with the second channel 224.

In the embodiment, the air inlet port 240 is directly formed at the outer circumference of the connector 210. Alternatively, as shown in FIG. 11, the air inlet port 240 may extend from a connection rib 242 connected between the connector 210 and the side 172 of the tub cover 170.

The connection rib 242 is approximately formed in the shape of a semicircle. The connection rib 242 protrude inward from the side 172 of the tub cover 170.

As previously described, the connector 210 is inclined upward to the bottom 174 of the tub cover 170. At the same time, the connector 210 extends through the side 172 of the tub cover 170.

Consequently, the coupling part 250, connected to the circulation hose 190 located outside the tub 20, and the inlet port 252, provided at the inside of the coupling part 250, are located outside the tub 20. The outlet port 254, through which wash water falls into the tub 20 and the rotary tub 30, and the air inlet port 240, through which air from the tub 20 is introduced into the connector 210, are located inside the tub 20.

The position of the air inlet port 240 is not limited to the inside of the tub 20. This is because air outside the tub 20 may be introduced through the air inlet port 240.

In a case in which the air inlet port 240 is located inside the tub 20, however, foreign matter, such as external dust, is more effectively prevented from being introduced through the air inlet port 240 than in a case in which the air inlet port 240 is located outside the tub 20.

The connector 210 may be integrally formed at the tub cover 170. A manufacturing method of the tub cover 170 and the connector 210 and a material for the tub cover 170 and the connector 210 are the same as the tub connector 170 of the previous embodiment.

The wash water channel 220 and the air inlet port 240 provided at the connector 210 constitute a structure to generate bubbles in circulating wash water. i.e. a bubble generator.

Hereinafter, the principle by which air is supplied to wash water flowing in the connector 210 through the air inlet port 240 will be described.

When the wash water, flowing through the first channel 222, is introduced into the second channel 224, the diameter of which is less than that of the first channel 222, the flow speed of the wash water introduced into the second channel 224 becomes faster than that of the wash water flowing through the first channel 222 with the result that the pressure of the wash water is reduced in proportion to the increased flow speed of the wash water, according to the above-described Venturi effect.

The pressure difference between the second channel 224 and the outside of the connector 210 occurs in proportion to the reduced pressure in the second channel 224. Due to the pressure difference, air outside the connector 210 is introduced into the second channel 224 through the air inlet port 240 with the result that the air is mixed with the wash water.

Particularly in the connector 210 of this embodiment, as shown in FIG. 11, the second channel 224 is eccentrically formed in the connector 210 to maximize the Venturi effect.

In the structure in which the connector 210 is constituted by channels having different diameters, and the air inlet port 240 is further provided, the wash water is circulated and, at the same time, air is supplied to the wash water to generate bubbles.

A check valve 280 may be further provided in the air inlet port 240.

The check valve 280 is a one-way valve through which a fluid, such as air or water, flows in one direction.

At the initial operating stage or the last operating stage of the circulation pump 84, pressure applied to laundry is small or irregular as compared with the normal operating stage of the circulation pump 84. In this case, the Venturi effect does not normally occur in the connector 210 with the result that air may not be introduced into the second channel 224 and wash water flowing through the second channel 224 may fall through the air inlet port 240 due to gravity.

The check valve 280, provided in the air inlet port 240, is opened in the direction in which external air is introduced into the connector 210 and closed in the direction in which wash water in the connector 210 is discharged out of the connector 210, thereby preventing the occurrence of the above phenomenon.

Instead of the check valve 180, an electronic control valve 280' may be provided in the air inlet port 240.

The electronic control valve 280' is opened or closed by an additional controller (not shown). In a case in which the electronic control valve 280' is used, wash water may be circulated in a state in which air is supplied to the wash water (hereinafter, referred to as a 'bubble mode') or wash water may be circulated in a state in which air is not supplied to the wash water (hereinafter, referred to as a 'circulation mode').

That is, when the electronic control valve 280' is opened, air is introduced into the connector 210 through the air inlet port 240 with the result that the air is supplied to the wash water, and bubbles are generated as the wash water falls into the rotary tub 30 (bubble mode). When the electronic control valve 280' is closed, air is not introduced into the connector 210 with the result that the wash water is circulated in a state in which air is not supplied to the wash water (circulation mode).

Hereinafter, a control method to generate bubbles in wash water or circulate wash water using the circulation units of the embodiments during washing and rinsing of laundry will be described.

When laundry to be washed is introduced into the tub 20 and the washing machine is operated, wash water is supplied into the tub 20 from an external water supply source. The supplied water is circulated from the bottom of the tub 20 to the top of the tub 20 by the motor 86, the circulation pump 84 and the circulation unit and is sprayed into the tub 20 through the outlet ports 154 and 254. When the wash water flows in the wash water channels 120 and 220 provided in the circulation hoses 90 and 190 or the connectors 110 and 210 during circulation of the wash water, air from the tub 20 is introduced through the air inlet ports 140 and 240 according to the Venturi effect with the result that bubbles are generated while the air is sprayed into the tub 20 together with the wash water. During rotation of the tub 20, the wash water and the bubbles contained in the wash water remove contaminants from the laundry (washing cycle).

The washing cycle is repeatedly performed several times according to circumstances. During repetition of the washing cycle, the wash water is periodically circulated from the bottom of the tub 20 to the top of the tub 20 by the circulation unit and is sprayed into the tub 20. Bubbles generated during this process remove contaminants from the laundry (bubble mode).

When a sufficient amount of bubbles to wash the laundry are generated during the washing cycle, only the wash water is circulated without generating bubbles (circulation mode).

A control method to operate the washing machine in the bubble mode or the circulation mode may be performed using the electronic control valve 280' or the motor 86.

In the control method using the electronic control valve 280', as previously described, the electronic control valve 280' provided in the air inlet ports 140 and 240 is opened (bubble mode) or closed (circulation mode) so as to achieve switching between the bubble mode and the circulation mode.

In the control method using the motor 86, the motor 86 is controlled not to circulate the wash water with the result that bubbles are not generated.

Upon completion of the washing cycle, a rinsing cycle is performed (rinsing cycle).

The rinsing cycle includes a first rinsing cycle in which a softener, such as a rinse, is not used and a second rinsing cycle in which a softener is used. Particular in the second rinsing cycle in which the softener is used, generation of bubbles may not be necessary. Consequently, the electronic control valve 280' may be controlled so that the washing machine is operated in the circulation mode, or the motor 86 may be controlled so that wash water is not circulated, and therefore, bubbles are not generated.

A controller (not shown) provided in the washing machine determines whether the washing machine is operated in the washing cycle or in the rinsing cycle to control generation of bubbles. That is, in a case in which the washing machine is operated in the rinsing cycle (especially, the second rinsing cycle), in which generation of bubbles may not be necessary, the controller stops the operation of the bubble generator.

As is apparent from the above description, bubbles are generated in circulating wash water, thereby improving washing efficiency.

Also, the bubbles are generated at the upper part of the washing machine, reducing energy for bubble generation.

Also, the structure to circulate wash water or generate bubbles is simplified, thereby reducing production cost.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:
a machine body;
a tub disposed in the machine body;
a tub cover provided to cover the tub;
a pump to move wash water to the tub; and
a circulation unit, having one end coupled to the pump and the other end coupled to the tub cover, to circulate the wash water from the pump to the tub,
wherein the circulation unit comprises
a first channel;
a second channel communicating with the first channel, the second channel having a smaller sectional area than the first channel;
an air inlet port directly communicating with the second channel, the air inlet port being connected to the tub or tub cover by a connection hose, to allow air from the tub to be directly introduced into the circulation unit therethrough; and
a check valve provided in the air inlet port.

2. The washing machine according to claim 1, wherein the circulation unit comprises:
a connector provided at the tub cover; and
a circulation hose connected between the pump and the connector.

3. The washing machine according to claim 2, wherein the first channel and the second channel are provided in the circulation hose.

4. The washing machine according to claim 3, wherein the circulation unit comprises:
a connection pipe provided at the tub cover,
wherein the connection hose has one end coupled to the connection pipe and the other end coupled to the air inlet port, to guide air from the tub cover to the air inlet port.

5. The washing machine according to claim 4, wherein the tub cover further comprises a movement preventing rib protruding from one side of the tub cover to prevent movement of the connection hose.

6. The washing machine according to claim 2, wherein the first channel and the second channel are provided in the connector.

7. The washing machine according to claim 6, wherein the connector is provided at one side of the tub cover and inclined upward to a bottom of the tub cover.

8. The washing machine according to claim 7, wherein the air inlet port is provided at an outer circumference of the connector so as to communicate with the second channel.

9. The washing machine according to claim 8, wherein the air inlet port is disposed inside the tub.

10. A washing machine comprising:
a machine body;
a tub disposed in the machine body;
a tub cover provided to cover the tub;
a pump to move wash water to the tub; and
a circulation unit to circulate the wash water to the tub,
wherein the circulation unit comprises
a connector formed at one side of the tub cover;
a circulation hose connected between the connector and the pump, the circulation hose comprising a wash water channel to guide the wash water into the tub and an air channel directly connected to the wash water channel;
a connection hose to connect the air channel to the tub or tub cover, to supply air from the tub directly to the wash water; and
a control valve provided in one of the air channel and the connection hose.

11. The washing machine according to claim 10, wherein the connector comprises an inlet port into which the wash water having passed through the circulation hose is introduced, and
the wash water channel comprises
a first channel communicating with the inlet port; and
a second channel communicating with the first channel, the second channel having a smaller diameter than the first channel.

12. The washing machine according to claim 11, wherein the air channel communicates with the second channel.

13. The washing machine according to claim 12, wherein the circulation unit further comprises:
a connection pipe provided at the tub cover,
wherein the connection hose has one end coupled to the connection pipe and the other end coupled to the air channel, to guide air from the tub cover to the air channel.

14. The washing machine according to claim 13, wherein the tub cover further comprises a movement preventing rib protruding from one side of the tub cover to prevent movement of the connection hose.

15. A washing machine comprising:
a machine body;
a tub disposed in the machine body;
a tub cover provided to cover the tub;
a connector provided at the tub cover; and
a circulation hose connected between the tub cover and the connector,
wherein the connector comprises
a first channel;
a second channel communicating with the first channel, the second channel having a smaller sectional area than the first channel;
an air channel directly communicating the second channel to the tub or tub cover to directly supply air from the tub to the wash water; and
a check valve provided in the air channel.

16. The washing machine according to claim 15, wherein the connector is provided at a side of the tub cover and inclined upward to a bottom of the tub cover.

17. The washing machine according to claim 16, wherein the air channel is provided at an outer circumference of the connector.

18. The washing machine according to claim 17, wherein the connector is provided at one end thereof with a coupling part coupled to the circulation hose, the coupling part having an inlet port communicating with the first channel.

19. The washing machine according to claim 18, wherein the air channel is disposed inside the tub and the inlet port is disposed outside the tub.

20. The washing machine according to claim 19, wherein the connector is provided at the other end thereof with an outlet port communicating with the second channel.

21. The washing machine according to claim 20, further comprising a one-way valve provided in the air channel to prevent the wash water passing through the second channel from being introduced into the tub through the air channel.

22. The washing machine according to claim 21, wherein the connector is integrally formed at the tub cover.

* * * * *